US007007318B1

(12) United States Patent
Bork et al.

(10) Patent No.: US 7,007,318 B1
(45) Date of Patent: Mar. 7, 2006

(54) LAVATORY SYSTEM

(75) Inventors: Kevin W. Bork, West Allis, WI (US); Timothy E. Perrin, Hartford, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 327 days.

(21) Appl. No.: 10/366,681

(22) Filed: Feb. 12, 2003

Related U.S. Application Data

(60) Provisional application No. 60/356,233, filed on Feb. 12, 2002.

(51) Int. Cl.
*A47K 4/00* (2006.01)
*E03C 1/01* (2006.01)

(52) U.S. Cl. ..... 4/664; 4/254

(58) Field of Classification Search ..... 4/663, 4/664, 234, 241, 248, 253, 254, 246.1, 246.4
See application file for complete search history.

(56) References Cited

U.S. PATENT DOCUMENTS

| | | | |
|---|---|---|---|
| 37,896 | A | 3/1863 | Bissicks |
| 68,802 | A | 9/1867 | Staples |
| 127,540 | A | 6/1872 | Young |
| 135,817 | A | 2/1873 | Kent |
| 200,480 | A | 2/1878 | Rivera |
| 316,324 | A | 4/1885 | Barnwell |
| 345,890 | A | 7/1886 | Farson |
| 426,287 | A | 4/1890 | Larkin |
| 882,760 | A | 3/1908 | Hubert |

(Continued)

FOREIGN PATENT DOCUMENTS

| | | |
|---|---|---|
| JP | 54-144028 | 11/1979 |
| JP | 0274931 | 11/1990 |

OTHER PUBLICATIONS

Modular Services Company, "Bedside Lavatory Unit", bearing a designation of "©2000 Modular Services".
Acorn Engineering Company, "Care–Ware Patient Healthcare Systems", undated.
Plumbing Engineer, "Whitehall Manufacturing", "ADA Versalette™", p. 60, bearing a designation of "Jul. 1999".
Bradley, "Patient Care Application Guidelines", bearing a designation of "Copyright © 1999 Bradley Corporation".
Bradley, "News Release", "Bradley Introduces Patient Care Unit with Terreon® Top", bearing a designation of "Copyright © Bradley Corporation".
Bradley, "Installation and Maintenance Instructions" for "Bradley's LavCare™ 2000 Patient Care Module with Terreon® Lavatory Top", bearing a designation of "EN 98–1014".
Hygeia Lav Standard Co., "The *Module 100*", 1 page, undated.
Whitehall Manufacturing, "Versalette™Bedside Patient Care Units Model 4040 Series", 2 pages, bearing a designation of "Jun. 25, 2002".

*Primary Examiner*—Tuan Nguyen
(74) *Attorney, Agent, or Firm*—Foley & Lardner LLP

(57) ABSTRACT

A lavatory system is disclosed. The lavatory system comprises a base, a panel coupled to the base and configured for translating movement between a first position and a second position, a cover configured for pivoting movement relative to the base between a deployed position and a stowed position, a linkage coupled to the cover and the panel, and a motion control device including a damper configured to affect the movement of the cover and the panel. The linkage comprising at least one member configured to transfer the pivoting movement of the cover to translating movement of the panel. Movement of the cover from the deployed position towards the stowed position actuates the at least one member to move the panel from an extended position towards a retracted position. The damper is configured to control the velocity of the cover during movement.

38 Claims, 12 Drawing Sheets

U.S. PATENT DOCUMENTS 968,541 A 8/1910 Connelly
1,180,140 A 4/1916 Godoy
1,225,914 A 5/1917 Wood
1,342,505 A 6/1920 Kinch
1,409,330 A 3/1922 Aper
1,763,209 A 6/1930 Ayers et al.
1,763,277 A 6/1930 Tilden
1,793,815 A 2/1931 McCann
1,841,143 A 1/1932 McCann
D90,837 S 10/1933 Davison
D97,839 S 12/1935 Callahan
2,184,722 A 12/1939 McLoughlin ..... 4/169
2,198,605 A 4/1940 Faber ..... 4/2
2,267,618 A 12/1941 Shapiro ..... 4/2
D132,476 S 5/1942 Martin
D144,811 S 5/1946 Smith ..... D4/4
2,434,889 A 1/1948 Sacia ..... 4/235
2,443,214 A 6/1948 Williams ..... 4/10
D162,619 S 3/1951 Blashfield ..... D4/5
2,558,443 A 6/1951 Krenov ..... 4/2
2,611,134 A 9/1952 Jarrett et al. ..... 4/10
2,750,599 A 6/1956 Colonna ..... 4/10
2,860,348 A 11/1958 McClenahan ..... 4/3
2,879,519 A 3/1959 Mueller ..... 4/10
2,907,048 A 10/1959 Gould ..... 4/2
D190,795 S 7/1961 Rancorn ..... D4/4
D190,988 S 8/1961 Radcliff et al. ..... D4/4
2,994,887 A 8/1961 Thornton ..... 4/242
3,015,110 A 1/1962 Treand ..... 4/2
3,047,106 A 7/1962 Callahan ..... 189/1
D197,944 S 4/1964 Tiller ..... D4/2
D197,945 S 4/1964 Tiller et al. ..... D4/2
D197,946 S 4/1964 Tiller ..... D4/2
D197,947 S 4/1964 Tiller et al. ..... D4/4
D198,256 S 5/1964 Tiller et al. ..... D4/4
D199,048 S 9/1964 Tiller ..... D4/2
3,149,346 A 9/1964 Springer ..... 4/135
D203,253 S 12/1965 de Kanter ..... D4/4
D206,740 S 1/1967 Hoeffken ..... D81/19
3,419,911 A 1/1969 Wood ..... 4/10
3,436,764 A 4/1969 Colonna ..... 4/10
3,520,005 A 7/1970 Downes ..... 4/234
3,593,346 A 7/1971 Katona ..... 4/10
3,646,617 A 3/1972 Heald ..... 4/1
3,719,959 A 3/1973 Ekstrom ..... 4/168
3,780,383 A 12/1973 Katona ..... 4/10
3,829,906 A 8/1974 McPhee ..... 4/10
D233,149 S 10/1974 Campbell ..... D23/49
3,881,200 A 5/1975 Maier-Gerber ..... 4/166
3,905,051 A 9/1975 Gozdziewski ..... 4/134
4,030,145 A 6/1977 Rowan ..... 4/10
4,045,827 A 9/1977 Morris et al. ..... 4/3
4,060,859 A 12/1977 Anderson ..... 4/102
4,089,073 A 5/1978 Campbell ..... 4/3
D251,065 S 2/1979 Campbell ..... D23/49
4,138,748 A 2/1979 Zielinski ..... 4/312
4,142,255 A 3/1979 Togni ..... 4/1
4,142,256 A 3/1979 Campbell ..... 4/3
D252,038 S 6/1979 Morris et al. ..... D23/49
4,177,527 A 12/1979 Uhlig ..... 4/3
D256,153 S 7/1980 Juaire et al. ..... D23/48
4,221,441 A 9/1980 Bain ..... 312/228
D266,268 S 9/1982 Adamcik ..... D23/69
4,366,584 A 1/1983 Mchuma ..... 4/307
4,368,551 A 1/1983 Cummings ..... 4/661
4,396,240 A 8/1983 Henson ..... 312/237
D281,714 S 12/1985 Morris et al. ..... D23/49
4,561,130 A * 12/1985 Bumgardner et al. ..... 4/253
4,645,145 A 2/1987 Alie ..... 244/118.5
D288,709 S 3/1987 Campbell ..... D23/49
D288,710 S 3/1987 Campbell ..... D23/49
4,653,128 A 3/1987 Canalizo ..... 4/663
4,680,817 A 7/1987 Sloan et al. ..... 4/663
4,944,047 A 7/1990 Gagliano ..... 4/312
4,970,732 A 11/1990 Deng ..... 4/312
D331,621 S 12/1992 Tapolcai ..... D23/214
D352,096 S 11/1994 Tagg ..... D23/274
D394,495 S 5/1998 Hauser, II ..... D23/284
5,765,237 A 6/1998 Okamoto et al. ..... 4/300
5,852,833 A 12/1998 Gregoire ..... 4/246.3
5,960,483 A 10/1999 Delzer et al. ..... 4/420
D424,176 S 5/2000 Wheeler, III ..... D23/273
6,094,756 A 8/2000 Carter ..... 4/578.1
6,158,060 A 12/2000 Wheeler ..... 4/254
6,643,865 B1 * 11/2003 Bork et al. ..... 4/664

* cited by examiner

LAVATORY SYSTEM

CROSS-REFERENCE TO RELATED PATENT APPLICATIONS

The present application claims priority to U.S. Provisional Patent Application No. 60/356,233, titled Lavatory System, and filed Feb. 12, 2002, the full disclosure of which is hereby incorporated herein by reference. The following U.S. application is hereby incorporated herein by reference: U.S. patent application No. 09/775,191 entitled "Lavatory System," filed Feb. 1, 2001.

FIELD OF THE INVENTION

The present inventions relate to a lavatory system. The present inventions more specifically relate to a lavatory system including a toilet with a cover movable between a stowed position and a deployed position.

BACKGROUND

It is generally known to provide for a lavatory system for use in a home, commercial or institutional facility such as a medical care facility or the like. Known arrangements for lavatory systems may provide (in a compact design) a base (e.g., cabinet), a sink, water closet (i.e., with toilet), countertop, and may be configured with one or more accessories such as a bedpan washer, dialysis equipment, etc. Such lavatory systems may be configured to provide a movable cover for a toilet that (relative to the base) can be deployed to cover the toilet (and provide a seat) or lifted to stow the cover and allow access to (or use of) the toilet. However, such known arrangements for lavatory systems may present inconvenient or disadvantageous features in application or use, such as relative difficulty to use (e.g., effort and vigilance to stow or cover toilet), or to clean (or keep clean), or to maintain. Also, such known arrangements may present inconvenient or undesireable operation such as high impact or velocity deployment of the cover if the cover is dropped onto the toilet, which may cause a potential for an unpleasant or startling noise, or for damage to the cover, linkage, or toilet.

Accordingly, it would be advantageous to provide a lavatory system that has a compact design and a movable cover for the toilet. It would also be advantageous to provide a lavatory system with a mechanism for moving the cover relative to the base that is more convenient to use. It would further be advantageous to provide a lavatory system that is configured to control the velocity that the cover can be raised and/or lowered. It would further be advantageous to provide a lavatory system that is configured to be more convenient to clean, keep clean, and maintain. It would be desirable to provide for a lavatory system having one or more of these or other advantageous features.

SUMMARY OF THE INVENTION

The present invention relates to a lavatory having a base and a commode with a bowl, and an apparatus comprising a panel coupled to the base and configured for movement between a first position and a second position, a cover coupled to the panel and configured for movement between a first position and a second position, a first linkage coupled to the panel and the cover and configured to transfer movement of the cover to movement of the panel, and a second linkage including a motion control device coupled to the cover. The motion control device is configured to impede the velocity that the cover can move between the first position of the cover and the second position of the cover, and access to the bowl of the commode is at least partially obstructed by movement of the cover.

The present invention also relates to a lavatory system comprising a base, a panel coupled to the base and configured for translating movement between a first position and a second position, a cover configured for pivoting movement relative to the base between a deployed position and a stowed position, a linkage coupled to the cover and the panel, and a motion control device including a damper coupled to the cover. The linkage comprising at least one member configured to transfer the pivoting movement of the cover to translating movement of the panel. Movement of the cover from the deployed position towards the stowed position actuates the member to move the panel from an extended position towards a retracted position. The damper is configured to control the velocity of the cover during movement.

The present invention further relates to a lavatory system comprising a base, a cover coupled to the base, a panel hingedly coupled to the cover at an interface that forms a gap, and a barrier configured to extend at least partially across the gap.

DETAILED DESCRIPTION OF THE PREFERRED EMBODIMENTS

Figure 1:
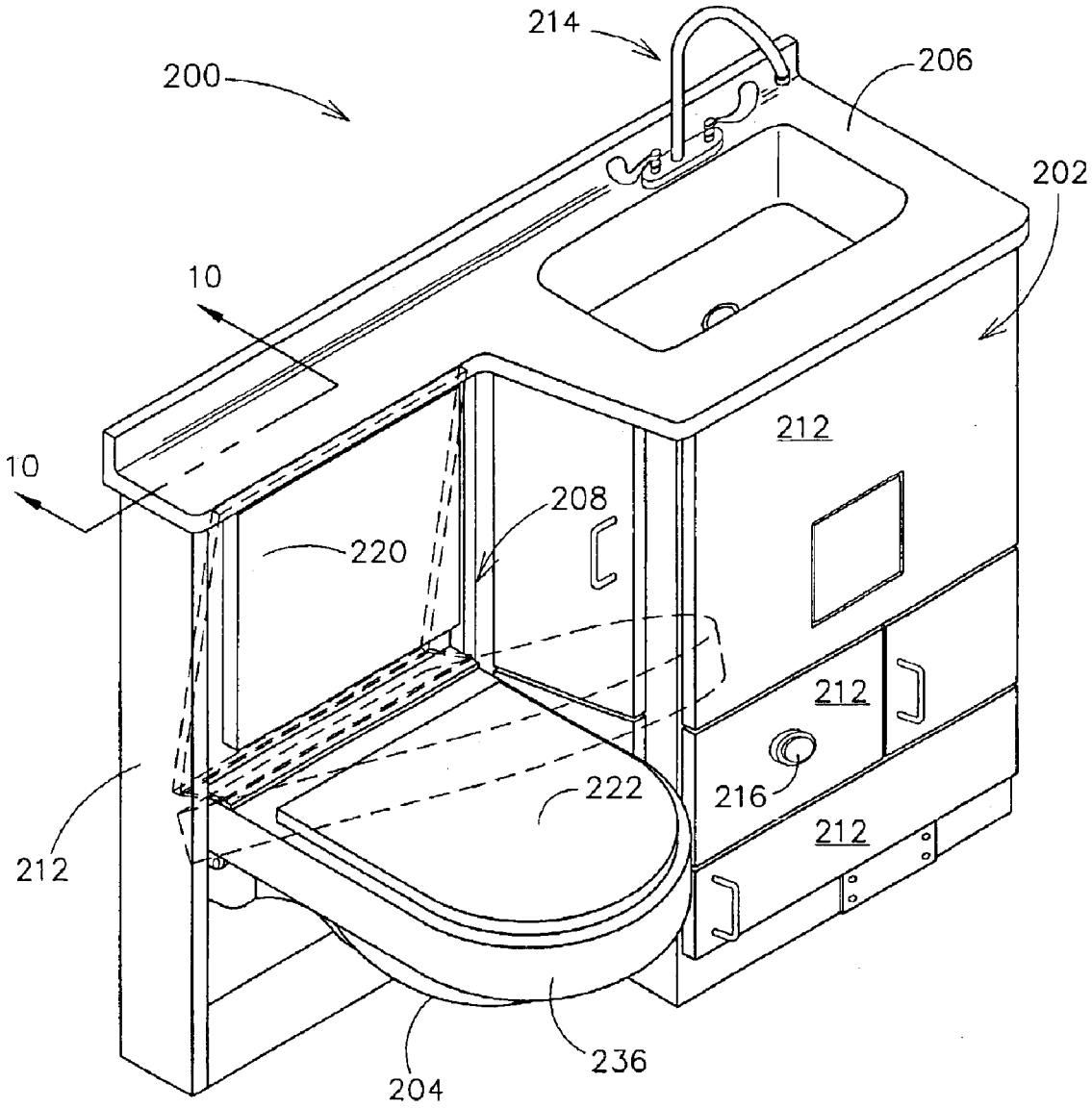
FIG. 1 is a perspective view of a lavatory system having a backrest and cover assembly with a cover in a deployed position according to a preferred embodiment.
Figure 2:
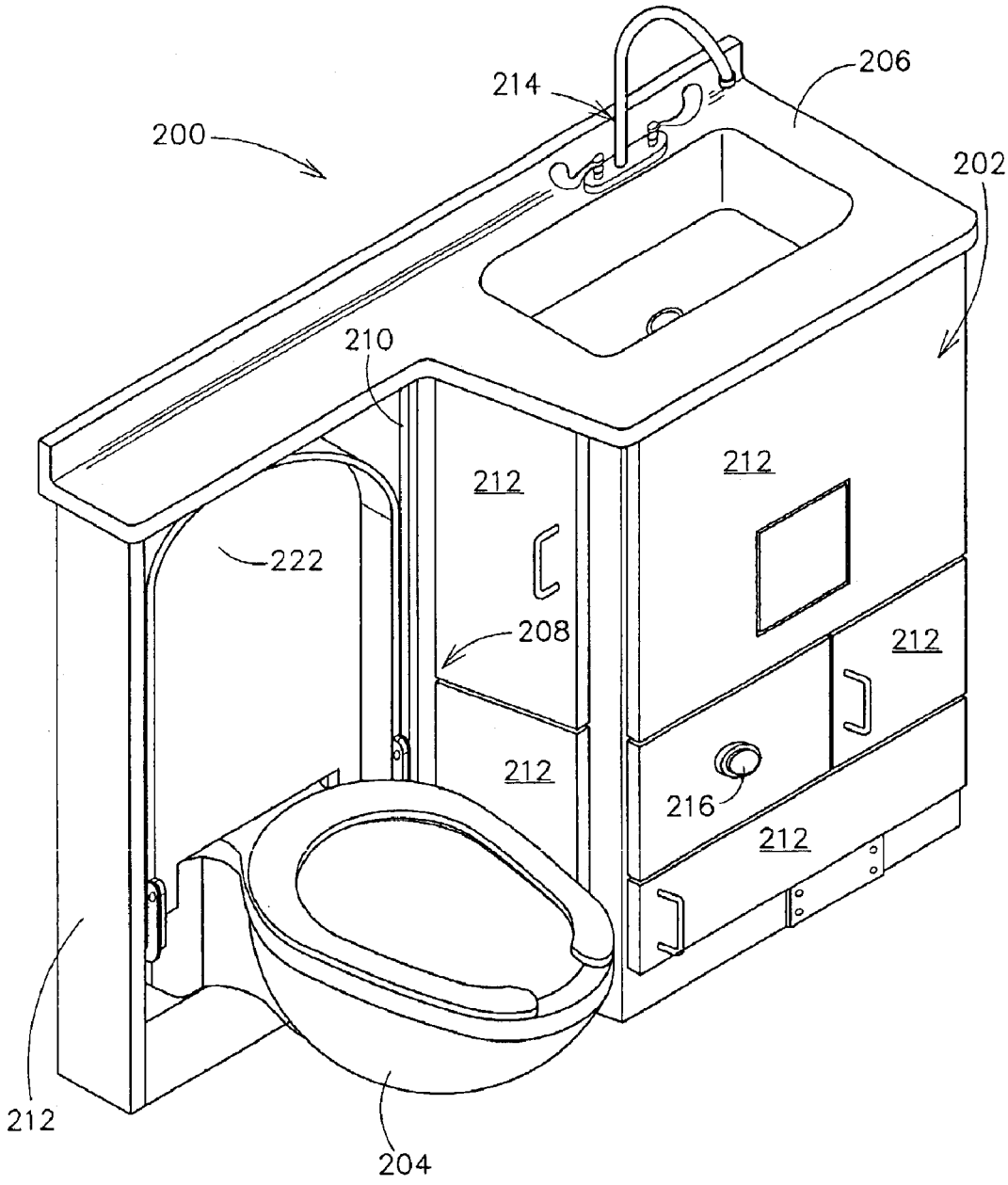
FIG. 2 is a perspective view of the lavatory system of FIG. 1 with the cover in a stowed position.

FIGS. 1 and 2 disclose a lavatory system 200 according to a preferred embodiment. Lavatory system 200 includes a base shown as a cabinet 202, a receptacle shown as a toilet or commode 204, one or more accessories (e.g., bedpan washer, dialysis equipment, etc.), a countertop 206 mounted to cabinet 202, and a backrest and cover assembly 208.

Figure 3:
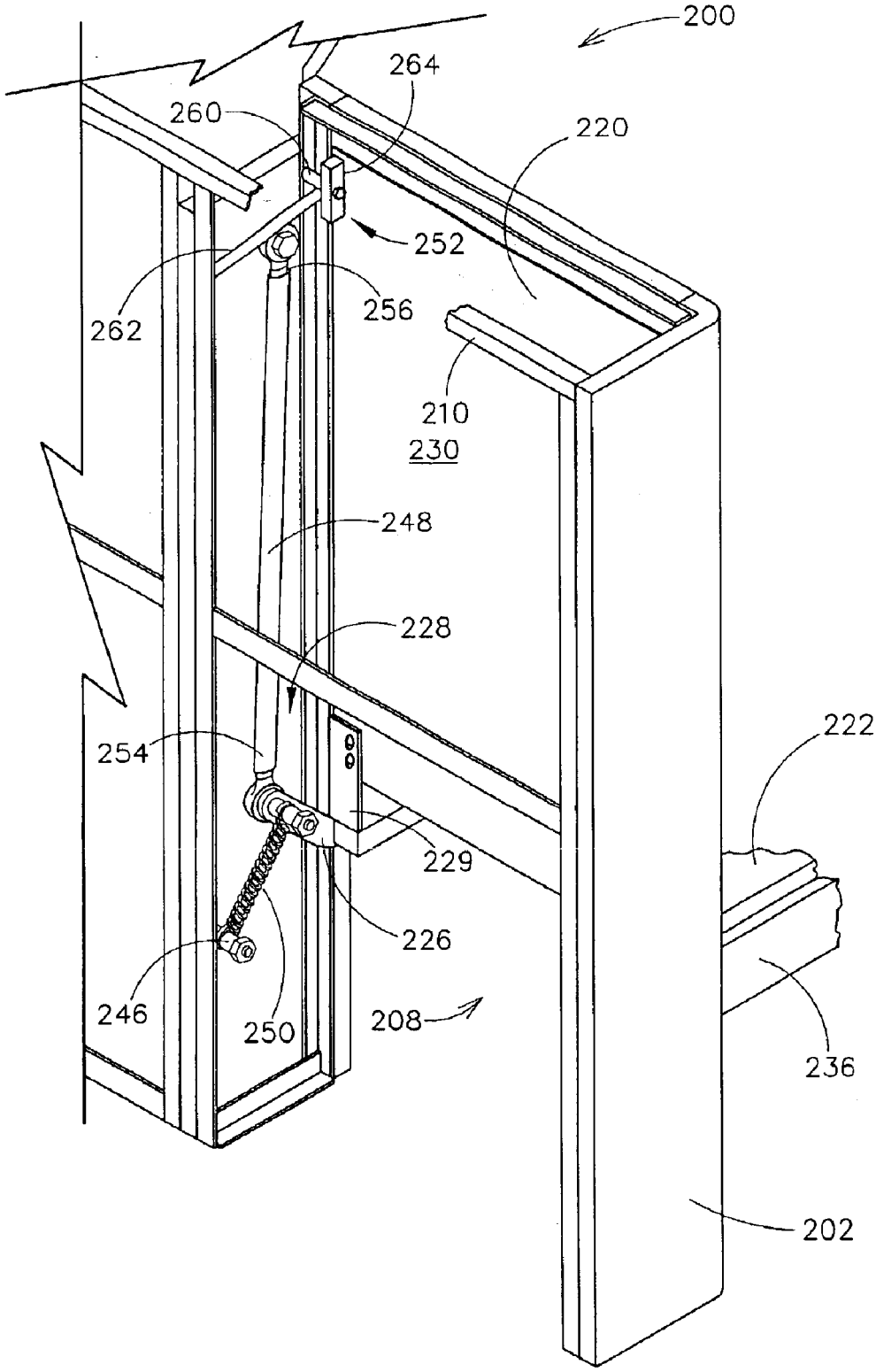
FIG. 3 is a fragmentary rear perspective view of the lavatory system of FIG. 1.

Referring to FIGS. 1–3, cabinet 202 includes a structural frame 210 and a plurality of panels 212 mounted on frame 210. Frame 210 is configured to support cabinet 202 and backrest and cover assembly 208. Frame 210 includes a plurality of support members (e.g., horizontal braces or members and vertical braces or members). The support members are connected by any of a variety of fabrication methods such as fasteners, welding, riveting, etc. A plumbing system for lavatory system 200 is generally enclosed by cabinet 202 and is in communication with commode 204, a faucet assembly 214, and the accessories. A valve operator (shown as a flush button 216) is mounted to cabinet 202 and configured to open and shut a flush valve upon manipulation by a user.

Backrest and cover assembly 208 includes a panel shown as a backrest 220, a cover 222 (which also serves as a seat), a pair of members 224 (coupling cover 222 to backrest 220), and a mechanism 228 that guides and controls movement of backrest 220 and cover 222.

Cover 222 provides a lid to cover the upper portion of the commode 204. Cover 222 also provides a surface for seating (e.g., a seat or seating surface) or for temporarily placing an object. The cover may be shaped and configured and otherwise adapted for any commode or receptacle. Backrest 220 provides support for the user to lean against when seated on the cover 222.

Cover 222 and backrest 220 are configured to move between a deployed or use position (see FIGS. 1, 3, 4, 6, and 9) and a retracted or stowed position (see FIGS. 2, 5, 8 and 9) relative to commode 204 and/or frame 210. In the deployed position, cover 222 is generally horizontal and backrest 220 is generally vertical. In the stowed position, both cover 222 and backrest 220 are generally vertical and retracted within cabinet 202. According to an alternative embodiment, the cover and backrest may have any of a variety of positions, configurations, or orientations when in the stowed position, deployed position, or therebetween.

According to a preferred embodiment shown in FIGS. 3–9, members 224 are configured to transfer "lifting" movement of cover 222 (e.g., pivoting) to "stowing" movement of backrest 220 (e.g., translation). One end of each member 224 is pivotally coupled to an edge of cover 222. The other end of member 224 is coupled to an edge of backrest 220. According to a particularly preferred embodiment, cover 222 and backrest 220 are configured to for both pivoting and translating movement. According to alternative embodiments, the cover and the backrest may be configured for a variety of pivoting, translating, articulating, actuating, constrained, restricted, guided, etc. movement, and in a variety of other paths of travel relative to the commode.

Figure 12:
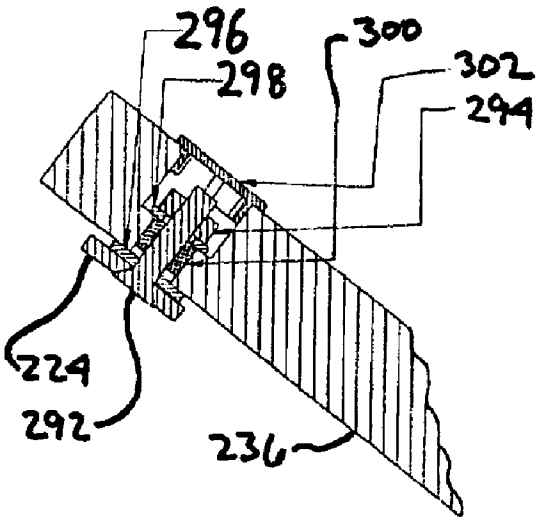
FIG. 12 is a fragmentary section view of the cover along lines 12—12 in FIG. 11.

According to a particularly preferred embodiment shown in FIG. 12, members 224 are coupled cover 222 by a fastener member 292 (e.g., a screw) engaging a nut 294 located within a recess of apron 236. According to a particularly preferred embodiment, fastener member 292 is welded to member 224. According to a particularly preferred embodiment, a washer 296 is located between member 224 and apron 236, a washer 298 is located between a shoulder of the recess in apron 236 and nut, and a bushing 300 supports fastener member 292 in a bore. The washers and/or bushing may be plastic, metal, fiber, or the like. According to a particularly preferred embodiment, a cap or plug 302 is coupled to apron 236 to cover the recess.

According to an exemplary embodiment, members 224 are spaced between approximately 3 inches and approximately 7 inches between pivot points and disposed (i.e., extend relative to each other) at an angle of between approximately 10 degrees and approximately 60 degrees (from horizontal). According to an exemplary embodiment, members 224 are spaced between approximately 4 inches and approximately 6 inches between pivot points and disposed (i.e., extend relative to each other) at an angle of between approximately 20 degrees and approximately 40 degrees (from horizontal). According to a preferred embodiment, members 224 are spaced between approximately 4.5 inches and approximately 5.5 inches between pivot points and disposed at an angle of between approximately 24 degrees and approximately 30 degrees (from horizontal). According to a particularly preferred embodiment, members are spaced approximately 4.8 inches and approximately 5.2 inches between pivot points and disposed at an angle between approximately 25 degrees and approximately 29 degrees (from horizontal). According to an alternative embodiment, the members may be configured or spaced in a variety of sizes or dimensions and be orientated or disposed at a variety of angles to transfer the movement between the cover and the backrest.

Figure 9:
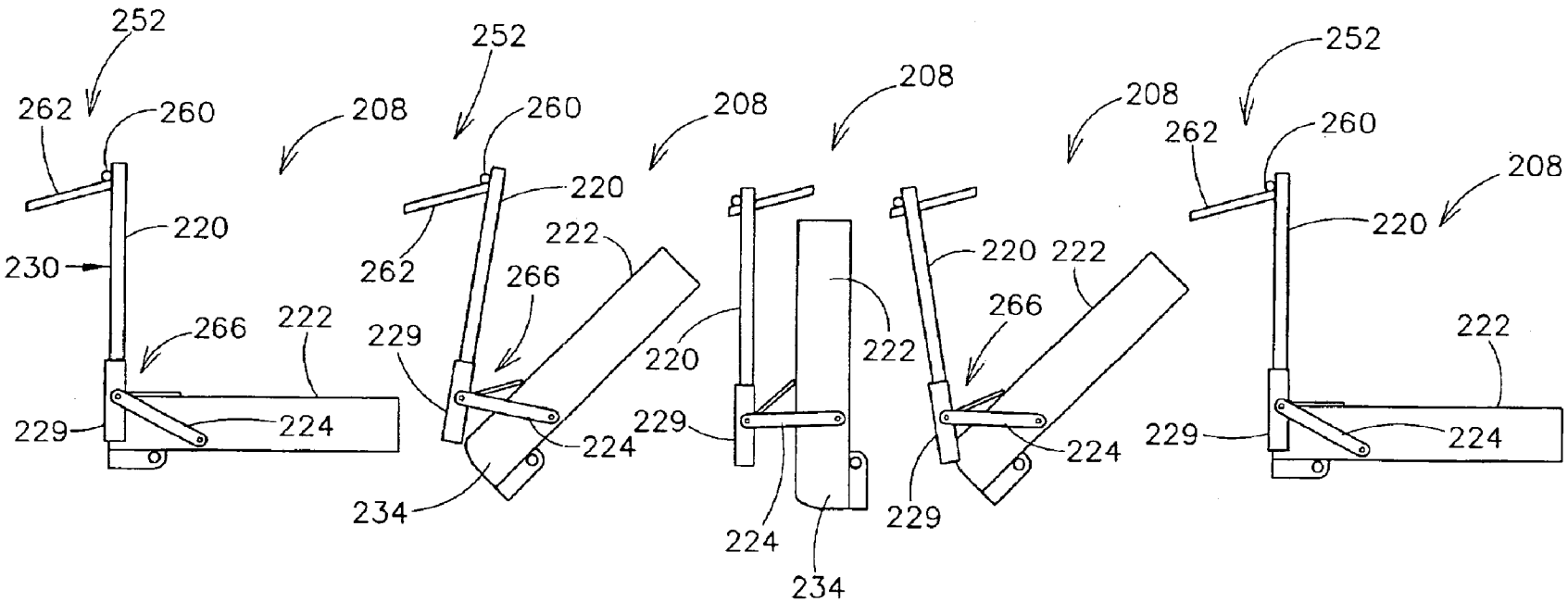
FIG. 9 is a series of side schematic views of the lavatory system with the cover moving between the deployed and stowed positions according to a preferred an exemplary embodiment.

According to a preferred embodiment, when cover 222 is in the generally vertical position, members 224 are configured to be in a generally horizontal position (see FIG. 9). According to alternative embodiments, the backrest and cover assembly may include a plurality of members (e.g., multi-bar or other linkages) configured to move the backrest to the stowed position and/or to prohibit pivoting of backrest 220 past a desired position (e.g., generally vertical) if pressure is applied (e.g., as when being rested or leaned against by a user).

Referring to FIGS. 3–8, a pair of support brackets 229 are mounted to backrest 220 and are configured to limit pivotal movement of backrest 220. According to an exemplary embodiment, the pivotal movement is prevented or restricted so that when a lateral force is being exerted upon backrest 220 (e.g., from someone sitting on cover 222 and leaning on backrest 220), movement of backrest 220 toward the interior of cabinet 202 is restricted or prevented. According to a preferred embodiment, each support bracket 229 is provided as an independent structure from members 224 and is mounted to backrest 220 (instead of to cover 222, as may be done according to alternative embodiments). According to a preferred embodiment, support brackets 229 are mounted to a rear surface 230 of backrest 220 and have lower portions 232 that extend below backrest 220 and adjacent or proximate to ends 234 of an apron 236 of cover 222 when cover 222 and backrest 220 are in the deployed position (i.e., approximately 90 degrees from each other). Pivotal movement of cover 222 beyond this position is restricted or prevented by the interference or contact between lower portions 232 and the ends 234 of cover 222. According to alternative embodiments, the support brackets may be configured to limit pivotal movement to any of a variety of angles between the backrest and the cover.

According to an exemplary embodiment shown in FIGS. 3–8, mechanism 228 affects the movement of backrest 220 and cover 222 between the deployed positions (see FIGS. 1, 3, 4, 6, and 9) and the stowed positions (see FIGS. 2, 5, 8, and 9). For example, mechanism 228 may be configured to control, assist, guide, resist, or the like the movement of backrest 220 and cover 222 between the deployed positions and the stowed positions. According to a preferred embodiment, mechanism 228 is configured to control or dampen the movement or velocity of cover 222 as it is being moved between its stowed and deployed positions. Controlling or dampening the movement or velocity of cover 222 is intended to avoid impact noise and potential damage to components such as cover 222, frame 210, cabinet 202, backrest 220, and the like (e.g., if a user accidentally or prematurely releases cover 222). Mechanism 228 includes an arm 226 (i.e., pivot arm), a motion dampening device shown as a damper 248, a biasing member (shown as a spring 250), and a follower assembly 252.

Figure 13:
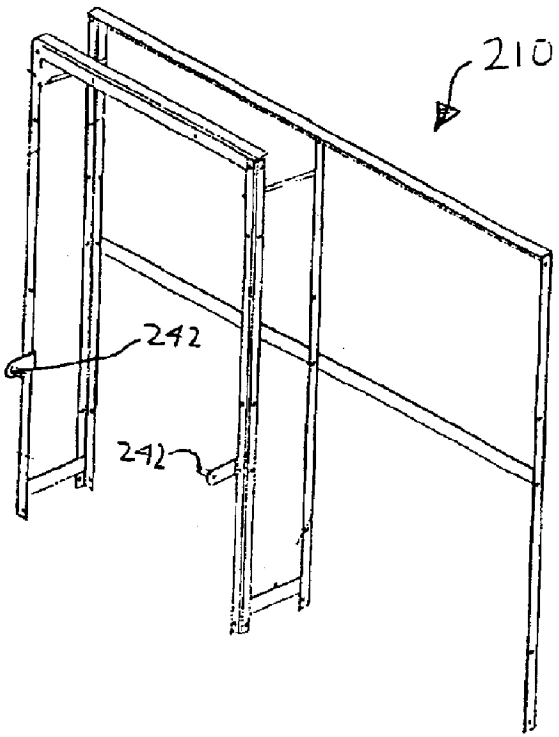
FIG. 13 is a perspective view of the frame for the lavatory system of FIG. 10.

Arm 226 includes a first portion 238 coupled to cover 222 and a second portion 240 coupled to cabinet 202 (e.g., via damper 248). According to an exemplary embodiment, second portion 240 extends from first portion 238 at an angle. According to a preferred embodiment shown in FIG. 4, second portion 240 projects or extends upward relative to first portion 238. According to an exemplary embodiment, second portion extends relative to first portion 238 between an angle of between approximately 110 degrees and approximately 125 degrees. According to a particularly preferred embodiment, second portion 240 extends upward at an angle of between approximately 118 degrees angle relative to first portion 238. According to alternative embodiments, the second portion may extend at any of a variety of angles (or linearly or parallel) relative to the first portion. Cover 222 and first portion 238 is coupled to frame 210 by a pivot shaft 242 (e.g., a bolt, pin, etc.). According to a preferred embodiment shown in FIG. 13, pivot shafts 242 are coupled to frame 210. Referring again to FIG. 4, second portion 240 is coupled to a pivot rod or shaft 244. First portion 238 is angled relative to second portion 240 for example, to provide clearance for one of a pair of support brackets 229 mounted on rear surface 230 of backrest 220. According to a particularly preferred embodiment, the linkage is made from rigid, corrosive-resistant materials (e.g., stainless steel), but may be made from any of a variety metals, plastics, or other suitable materials. According to an alternative embodiment, the mechanism or damper is coupled to the backrest and is configured to control and/or guide movement of the cover (and/or the backrest) by controlling and/or guiding the movement of the backrest.

Damper 248 is configured to provide an impedance or resistance to movement of cover 222 to control the velocity of movement of cover 222. When cover 222 is being moved (e.g., towards the stowed portion and/or towards the deployed position), damper 248 provides a resisting or impeding force. According to a preferred embodiment, damper 248 also provides a biasing force (e.g., a return force) that biases cover 222 in the stowed position (e.g., to assist in the movement of cover 222 towards the stowed position and to counteract a torque force due to the weight of cover 222). An applied force from damper 248 increases to approach the force of the input load (which is provided by the user lifting or lowering cover 222). The applied force approaches a zero-net force, resulting in zero acceleration and a constant velocity which is preferably limited to a desired value. (As such, the applied force is configured to counter-balance the torque created by movement of cover 222.) One end 254 of damper 248 is coupled to pivot shaft 244 and the other end 256 coupled to cabinet 202 by another pivot shaft or rod.

According to a preferred embodiment, damper 248 is a gas or pneumatic spring that provides a constant impedance or resistance to movement of cover 222 and is biased to its extended position. According to an exemplary embodiment, damper 248 provides a varying impedance or resistance to movement of cover 222. According to a particularly preferred embodiment, the damper is of a type commercially available as "Camloc" (Model No. SWY85825030958D) from Arvin Motion Control of Leicester, England. According to alternative embodiments, the damper may be any of a variety of air, gas, liquid, elastomer, spring, or hydraulic devices, shocks, or shock absorber, dashpot mechanisms, air spring, cylinders, actuators that dampen or resist motion or combinations thereof. According to further alternative embodiments, the damper provides a variable impedance or resistance (e.g., an increasing or decreasing amount of impedance, a partial dampening stroke, and the like).

Biasing member (shown as spring 250) biases cover 222 to a position approximately midway between the deployed and stowed positions (e.g., approximately 45 degrees). Spring 250 is coupled at one end to pivot shaft 244, and at the other end to a shaft 246 extending from cabinet 202. Spring 250 biases cover 222 so that an opposing force is exerted on cover 222 when moved near the stowed or deployed position (e.g., to assist the user in starting the movement of cover 222, and prevent a large acceleration of cover 222 into the stowed position). As cover 222 is moved towards the stowed position, the torque force due to the weight (moment) of cover 222 decreases and may become less than the biasing or return force provided by damper 248. As such, spring 250 is configured to compensate for (e.g., counterbalance) the reduced torque force to prevent or restrict cover 222 from undesired movement or from moving the remainder of the distance to the stowed position at an undesired rate of speed. According to an alternative embodiment, the spring is configured to affect movement of the cover at or near either the stowed or the deployed positions, during all or substantially all of the range of movement of the cover, or other ranges of movement or relative positions of the cover and/or the backrest. According to an alternative embodiment, the spring is positioned, selected spring constant, sized, etc. to affect movement of the cover at or near either the stowed or the deployed positions, during all or substantially all of the range of movement of the cover, or other ranges of movement or relative positions of the cover and/or the backrest Referring to FIGS. 3 and 9, follower assembly 252 is configured to support backrest 220 and maintain backrest 220 in a generally vertical position when in the deployed or stowed positions. According to a preferred embodiment, follower assembly 252 is mounted at both sides of backrest 220. Each follower assembly 252 includes a shaft 260 that is supported by and slides along a pair of guide rods 262 (e.g., cam, track, bracket, arm, etc.). Shaft 260 extends from a pair of brackets 264 mounted to rear surface 230 of backrest 220. Guide rods 262 are attached to the frame 210 and provide a sliding bearing surface for shafts 260. Guide rods 262 are sloped generally downward so that the backrest 220 moves downward relative to countertop 206 when moving to the stowed position. As cover 222 is moved between the deployed and stowed positions, shafts 260 slide along guide rods 262. According to alternative embodiments, the follower assembly may be any of a variety of mechanisms. For example, the follower assembly may be any of a variety of followers, follower mechanisms, guide mechanisms or assemblies, track mechanisms or assemblies, or the like.

Movement or actuation of cover 222 is initiated by the user lifting cover 222 from its deployed position and moving it towards its stowed position. As cover 222 begins to move, it pivots relative to backrest 220 (abuts ends of members 224). Pivoting of members 224 causes backrest 220 to move towards the interior of the cabinet. As such, follower assembly 252 works to maintain backrest 220 in a generally vertical orientation by shafts 260 sliding along guide rods 262.

FIG. 9 shows backrest and cover assembly 208 during use. As cover 222 is rotated, members 224 rotate about their ends (attached to cover 222 and backrest 220) to move (e.g., pivot and/or translate) backrest 220 between the deployed and stowed positions. As cover 222 is pivoted, pivot arm 226 moves pivot shaft 244 and actuates damper 248, which impedes movement of cover 222. Mechanism 228 is configured to control or dampen the movement or velocity of cover 222 as it is being moved between its stowed and deployed positions. Controlling or dampening the movement or velocity of cover 222 is intended to avoid impact noise and potential damage to components. Also, shafts 260 slide along guide rods 262 as backrest 220 actuates.

Figure 4:
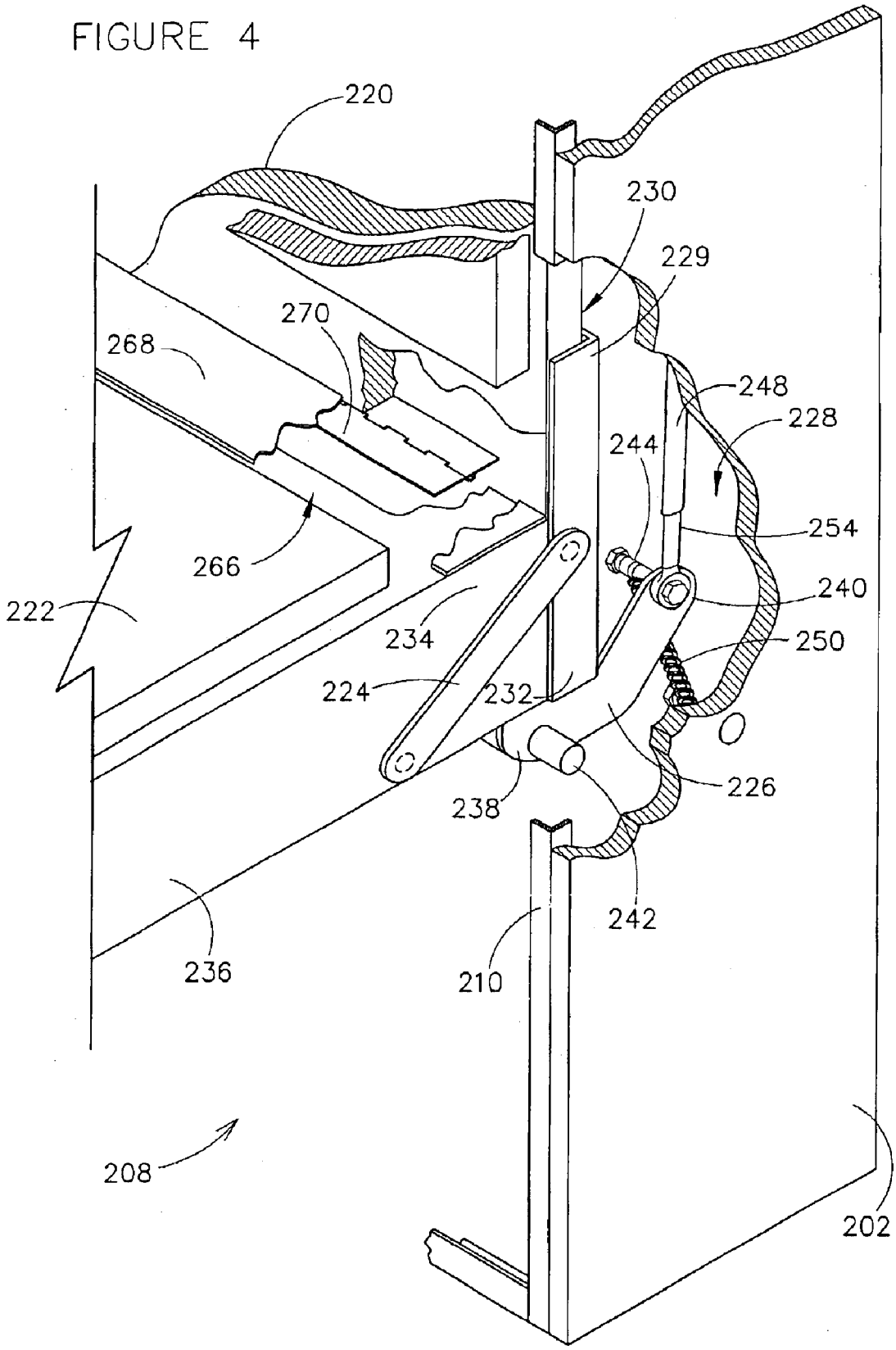
FIG. 4 is a fragmentary perspective view of the lavatory system of FIG. 1 with the cover in the deployed position.
Figure 5:
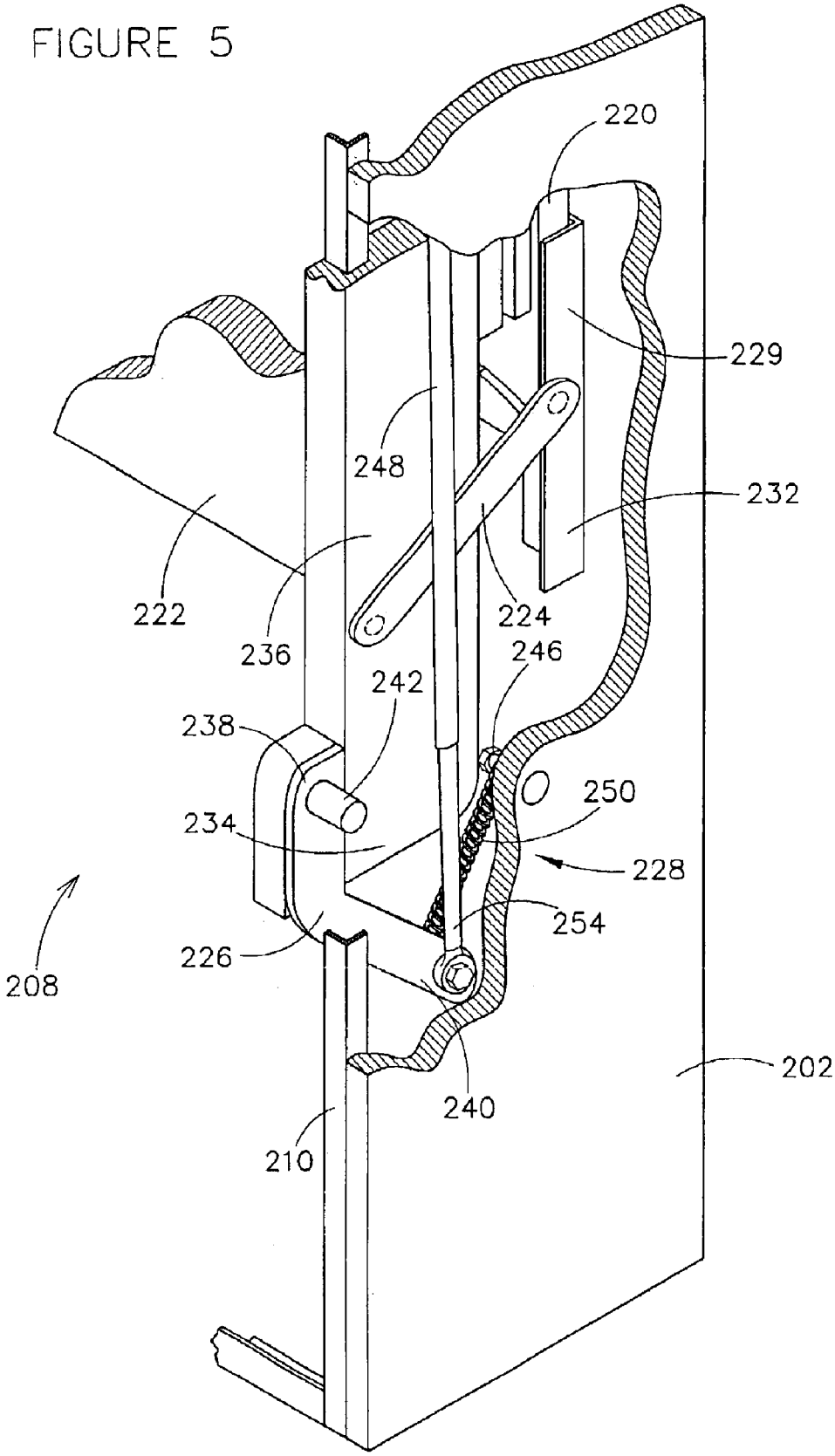
FIG. 5 is a fragmentary perspective view of the lavatory system of FIG. 2.
Figure 6:
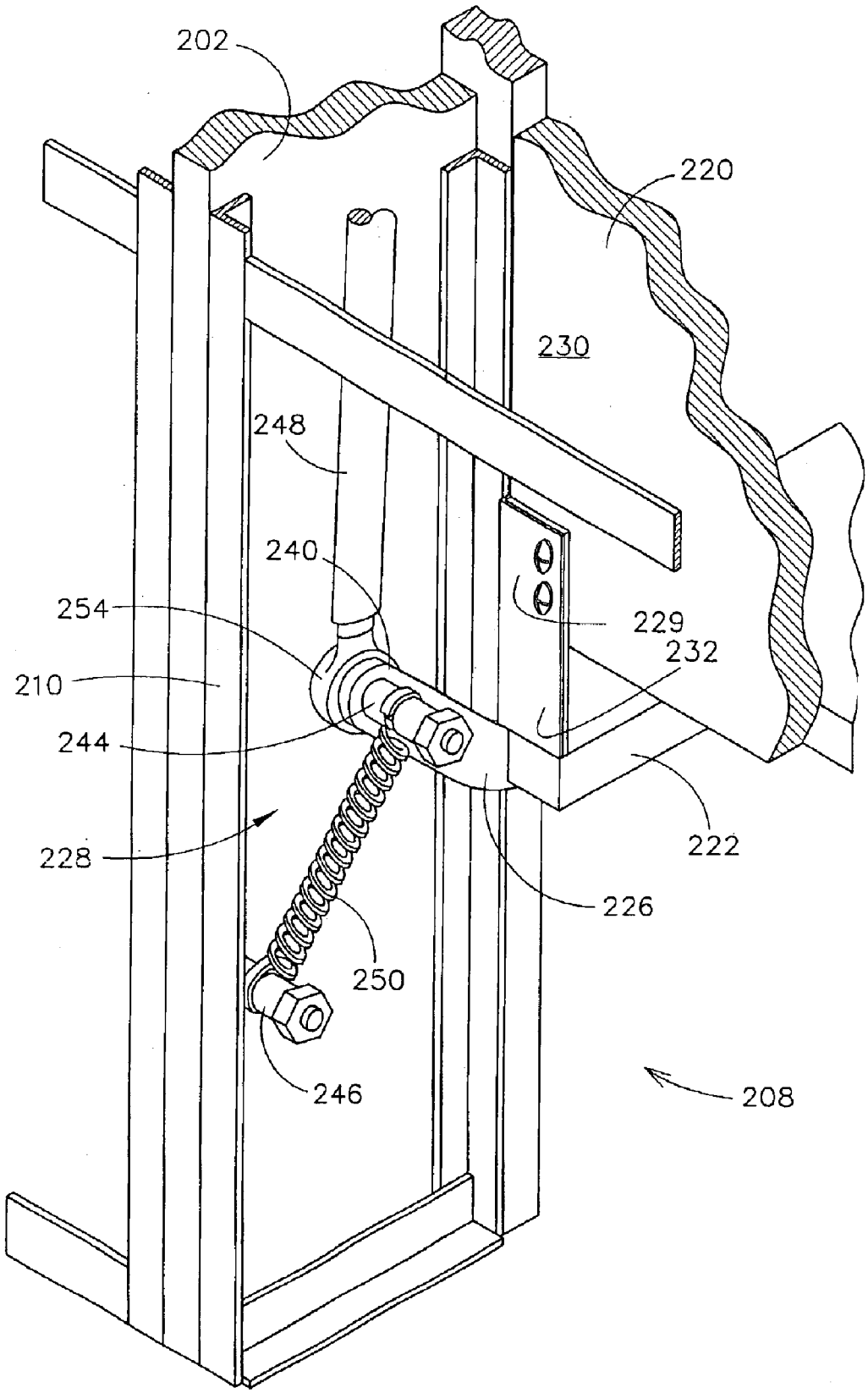
FIG. 6 is a fragmentary rear perspective view of the lavatory system of FIG. 1.
Figure 7:
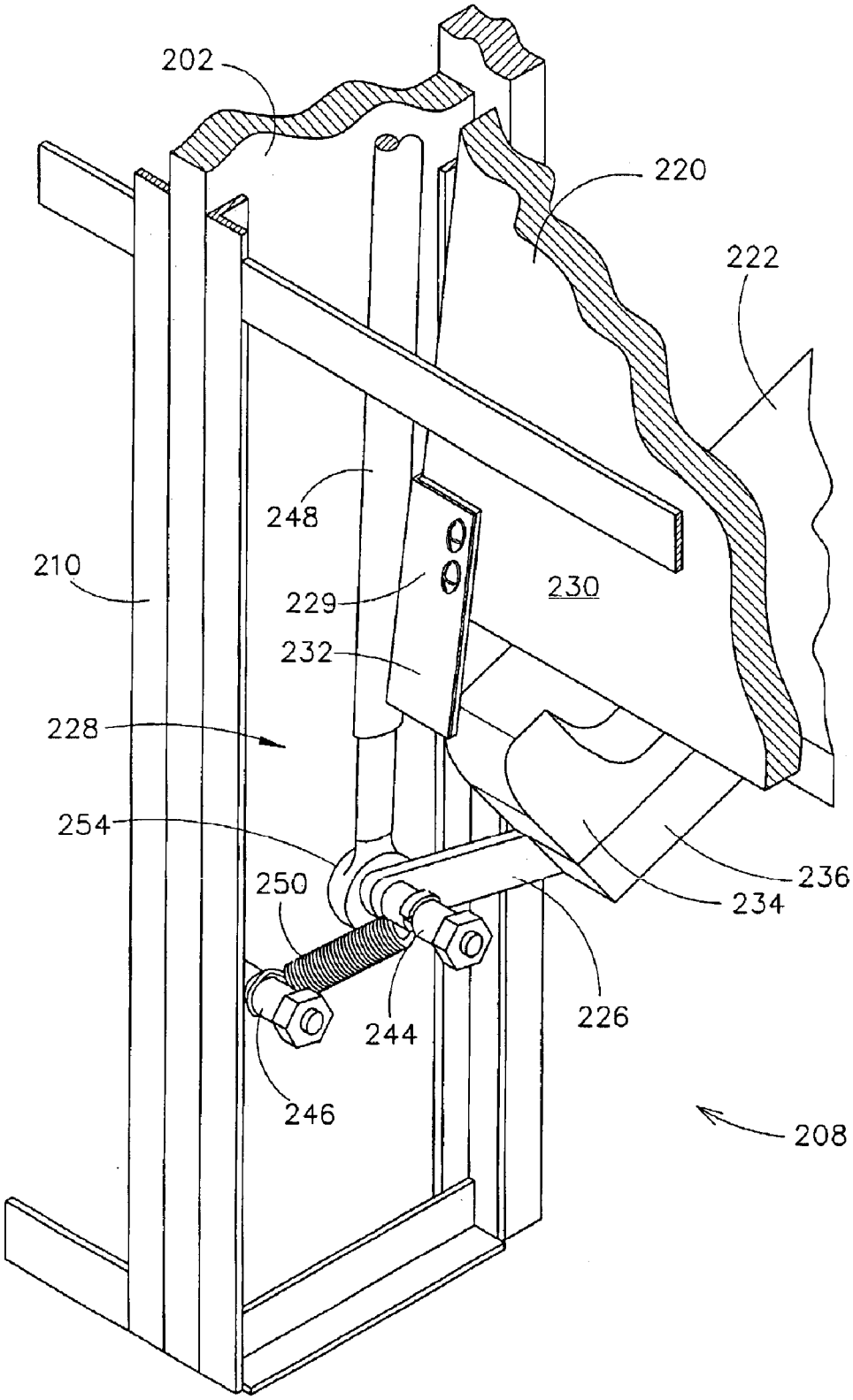
FIG. 7 is a fragmentary rear perspective view of the lavatory system of FIG. 1.
Figure 8:
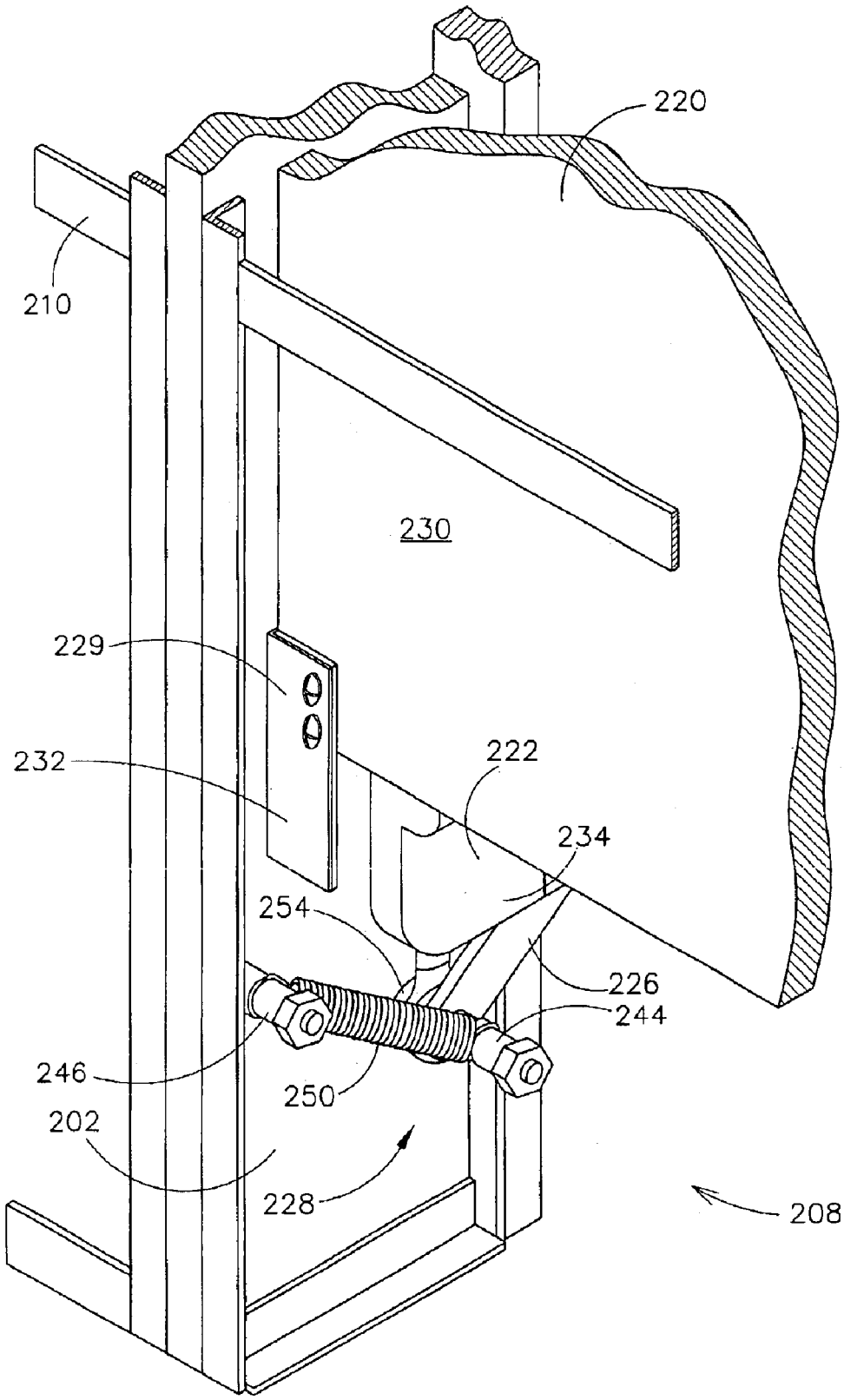
FIG. 8 is a fragmentary rear perspective view schematic block flow diagram of the lavatory system of FIG. 2.

Referring to FIGS. 1, 4, and 9, a barrier 266 is mounted at the interface of cover 222 and backrest 220 and is configured to cover the gap between cover 222 and backrest 220. Barrier 266 includes a panel 268 coupled to backrest 220 by a hinge 270. Panel 268 may be rigid, semirigid, flexible, plastic, cloth, metal, a web, movable with cover and/or backrest, removable and/or replaceable (e.g., if becomes wet, soiled or the like), etc. Hinge 270 may be provided in any of a variety of configurations such as hinge designs, including a barrel hinge (as shown), a flexible member, a rigid member (flexibly coupled), or the like.

Figure 10:
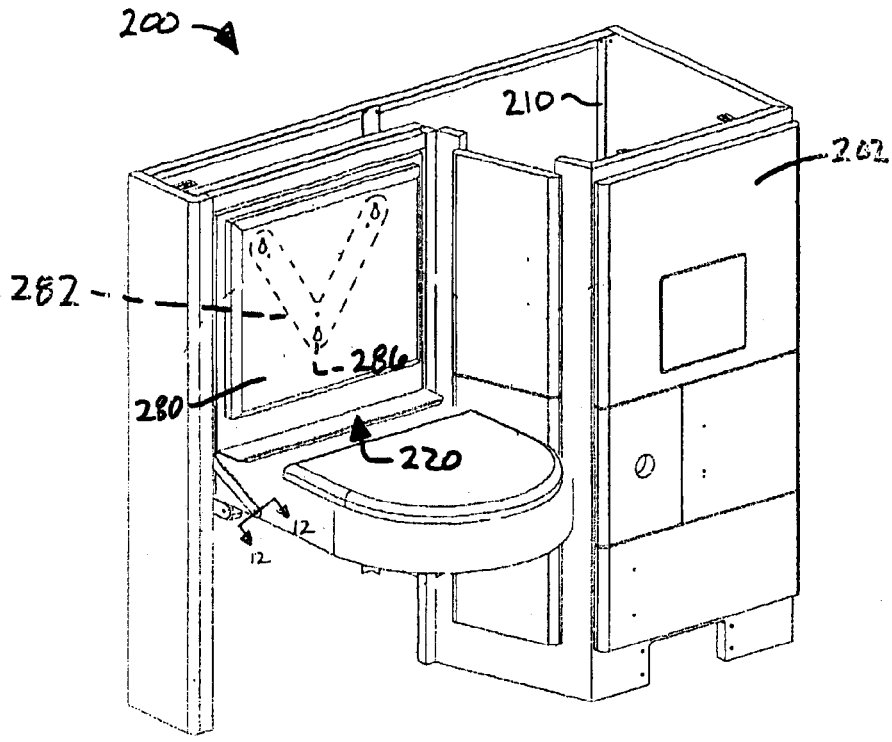
FIG. 10 is a perspective view of a lavatory system with a removable backrest pad according to a preferred embodiment.
Figure 11:
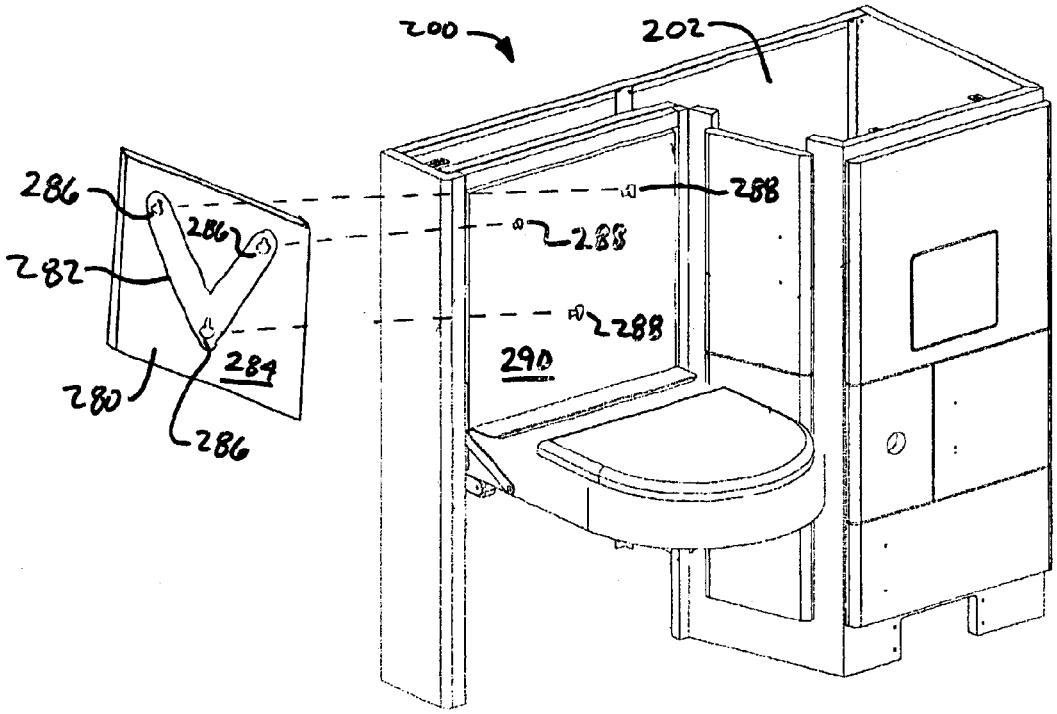
FIG. 11 is a perspective view of the lavatory system of FIG. 10 with the backrest pad exploded off of the backrest.

According to a preferred embodiment shown in FIGS. 10 and 11, a backrest pad 280 is removably attached to backrest 220 (e.g., for cleaning, replacement, removal, etc.). FIG. 10 is a perspective view of lavatory system 200 with removable backrest pad 280 and FIG. 11 is a perspective view of lavatory system 200 with backrest pad 280 exploded off of backrest 220. According to a preferred embodiment, backrest pad 280 includes a bracket 282 mounted to the back (i.e., non-show) surface 284 of backrest pad 280. Bracket 282 includes apertures 286 that engage members 288 projecting from a surface 290 of backrest 220. According to a particularly preferred embodiment, apertures 286 are slots having a narrow portion (i.e., dimension) at one end and a wide portion, and members 288 include a head portion that passes through the wider portion but is dimensioned to not pass through the narrow portion. According to alternative embodiments, the apertures may be any of a variety of openings, holes, slots, grooves, notches, keyhole slots, or the like, and the members may be any of a variety of posts, screws, bolts, shoulder bolts, projections, or the like. To mount backrest pad 280 to backrest 220, members 288 are aligned and inserted through the wide portion of apertures 286 and backrest pad 280 is moved so that members 288 engage the narrow portion of apertures 286 (e.g., slid downward).

Figure 14:
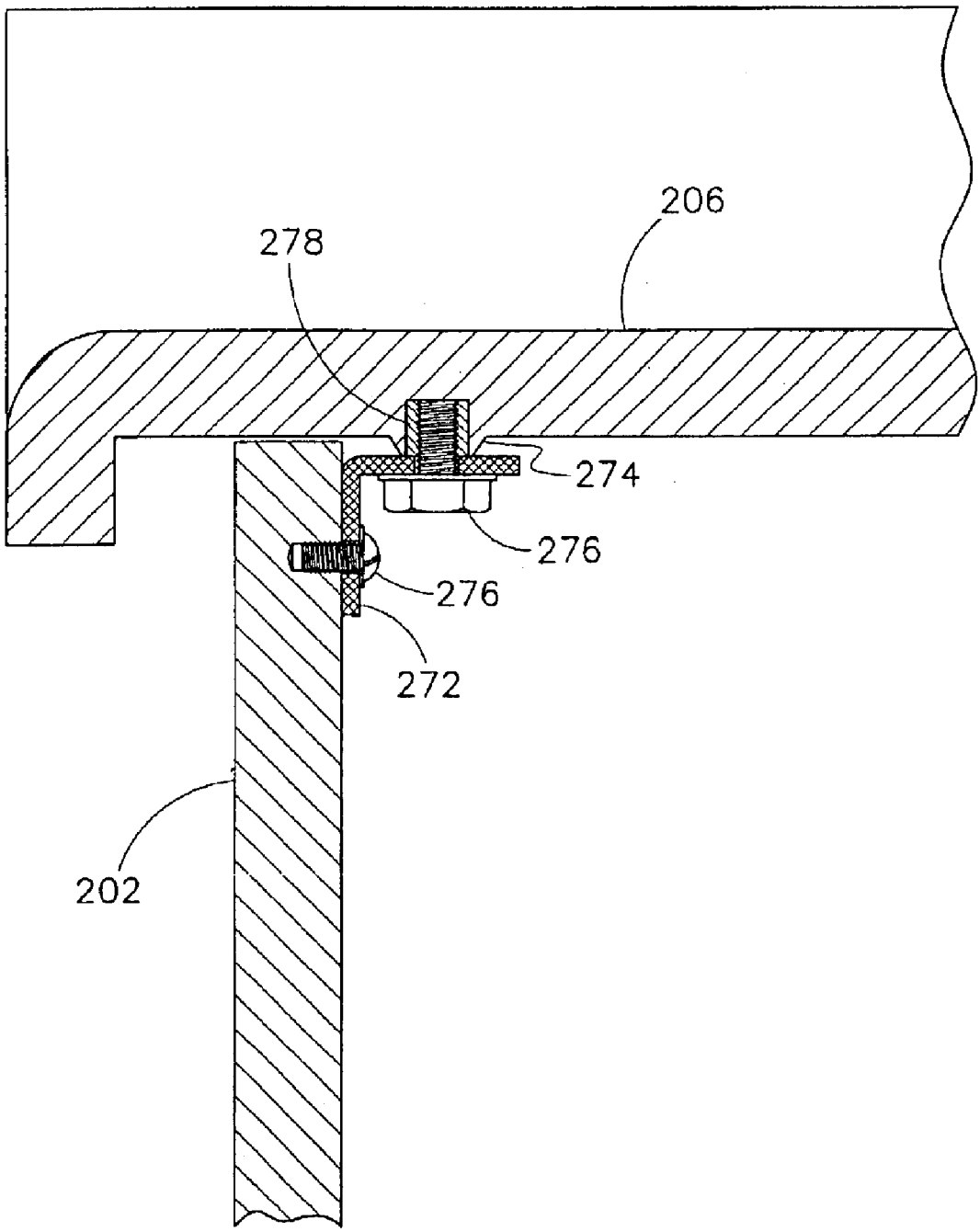
FIG. 14 is a fragmentary sectional view of an interface between the cabinet and the countertop according to a preferred embodiment.

Referring to FIG. 14, countertop 206 is coupled to frame 210 or cabinet 202 by one or more brackets 272. According to a preferred embodiment, the bottom surface of countertop 206 includes one or more guides 274 (e.g., bosses, protrusions, bumps, etc.) that assist in the positioning of countertop 206 relative to brackets 272. Ends of guides 274 interface (e.g., engage, fit into, etc.) with apertures in brackets 272 to "locate" countertop 206. Fasteners 276 secure countertop 206 to frame 210 or cabinet 202 (e.g., threadably engage inserts 278).

It is also important to note that the construction and arrangement of the elements of the lavatory system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces (e.g. clamps, etc.) or linkages may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures and combinations. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. In a lavatory having a base and a commode with a bowl, an apparatus comprising:

a panel coupled to the base and configured for movement between a first position and a second position;

a cover coupled to the panel and configured for movement between a first position and a second position; and a first linkage including a motion dampening device coupled to the cover and configured to dampen the movement of the cover;

wherein access to the bowl of the commode is at least partially obstructed by movement of the cover.

2. The apparatus of claim 1 wherein the cover is deployed in the first position of the cover and is stowed in the second position of the cover.

3. The apparatus of claim 2 wherein the cover is configured to provide a seating surface when deployed and wherein the panel is a backrest.

4. The apparatus of claim 1 wherein the panel is deployed in the first position of the panel and stowed in the second position of the panel.

5. The apparatus of claim 1 further comprising a second linkage coupled to the panel and the cover and configured to transfer movement of the cover to movement of the panel.

6. The apparatus of claim 1 wherein the motion dampening device provides a first force that biases the cover in at least one of the first position or the second position.

7. The apparatus of claim 6 wherein the first force is configured to assist the movement of the cover and to counteract a second force generated by the weight of the cover.

8. The apparatus of claim 1 wherein the motion dampening device comprises at least one of a gas spring, a shock, a damper, a hydraulic shock, or a solid spring.

9. The apparatus of claim 1 wherein the motion dampening device is configured to provide a generally constant impedance.

10. The apparatus of claim 1 wherein the motion dampening device is configured to provide a varying impedance to movement of the cover.

11. The apparatus of claim 1 further comprising a biasing member coupled to the cover and configured to provide a biasing force on the cover.

12. The apparatus of claim 11 wherein the biasing force is applied to the cover when the cover is near at least one of the first position of the cover or the second position of the cover.

13. The apparatus of claim 12 wherein the biasing force applied to the cover is reduced when the cover is generally midway between the first position of the cover and the second position of the cover.

14. The apparatus of claim 12 wherein the biasing force is configured to assist in initiating movement of the cover from at least one of the first position of the cover or the second position of the cover.

15. The apparatus of claim 11 wherein the biasing force is applied to the cover when the cover is near the first position of the cover and the second position of the cover.

16. The apparatus of claim 11 wherein the biasing member comprises a spring.

17. The apparatus of claim 1 wherein the motion dampening device is configured to dampen the velocity that the cover can move between the first position of the cover and the second position of the cover.

18. The apparatus of claim 1 wherein the movement of the panel between the first position of the panel and the second position of the panel is translating movement so that the panel remains substantially vertical and wherein the movement of the cover between the first position of the cover and the second position of the cover is pivoting movement.

19. The apparatus of claim 18 wherein the second linkage comprises a member having a first portion coupled to the cover and a second portion coupled to the motion control device and a biasing member having a first end coupled to the member and a second end coupled to the base.

20. The apparatus of claim 1 wherein the motion dampening device is configured to dampen the movement of the cover between the first position of the cover and the second position of the cover.

21. The apparatus of claim 3 further comprising a backrest pad coupled to the backrest, wherein the backrest pad is removable from the backrest by selective engagement of one or more projections and one or more apertures.

22. The apparatus of claim 21 wherein the projections extend from the backrest and the apertures are located on a bracket coupled to the backrest pad.

23. A lavatory system comprising:

a base;

a panel coupled to the base and configured for translating movement between a first position and a second position;

a cover configured for pivoting movement relative to the base between a deployed position and a stowed position;

a linkage coupled to the cover and the panel, the linkage comprising at least one member configured to transfer the pivoting movement of the cover to translating movement of the panel; and a motion control device including a damper coupled to the cover;

wherein movement of the cover from the deployed position towards the stowed position actuates the at least one member to move the panel from an extended position towards a retracted position; and wherein the damper is configured to control the velocity of the cover during movement.

24. The lavatory system of claim 23 wherein the damper also provides a biasing force that biases the cover in the first position or the second position.

25. The lavatory system of claim 24 wherein the biasing force is configured to assist the movement of the cover and to counteract the torque force generated by the weight of the cover.

26. The lavatory system of claim 23 further comprising a biasing member coupled to the cover and configured to apply a biasing force on the cover.

27. The lavatory system of claim 26 wherein the biasing force is applied to the cover when the cover is near at least one of the first position or the second position.

28. The lavatory system of claim 26 wherein the biasing force is configured to assist in initiating movement of the cover from at least one of the first position or the second position.

29. The lavatory system of claim 23 wherein the damper is configured to provide a constant impedance to movement of the cover.

30. The lavatory system of claim 23 further comprising a barrier mounted adjacent to a gap between the cover and the panel.

31. The lavatory system of claim 30 wherein the barrier is hingedly coupled to the cover or the panel along a first edge.

32. The lavatory system of claim 31 wherein the barrier is configured to pivot about a hinge as the cover moves between the first position and the second position.

33. The lavatory system of claim 32 wherein a second side of the barrier is configured to slide along the surface of the cover as the cover moves between the first position and the second position.

34. The lavatory system of claim 23 wherein the base comprises a bracket and a top mounted to the bracket, wherein the top includes one or more projections configured to engage the bracket to the position the top relative to the bracket prior to assembly.

35. A lavatory system comprising:

a base;

a commode:

a cover coupled to the base and configured for movement between a stowed position which allows access to the commode and a deployed position which obstructs access to the commode;

a backrest coupled to the cover at an interface that forms a gap between the cover and the backrest; and a barrier configured to extend at least partially across the gap to inhibit access to the commode through the gap.

36. The lavatory system of claim 35 wherein the barrier is hingedly coupled to the cover or the backrest along a first edge.

37. The lavatory system of claim 35 wherein the barrier is configured to pivot about a hinge as the cover moves between the stowed position and the deployed position.

38. The lavatory system of claim 35 wherein a portion of the barrier is configured to slide along the surface of the cover as the cover moves between the stowed position and the deployed position.

* * * * *

UNITED STATES PATENT AND TRADEMARK OFFICE

CERTIFICATE OF CORRECTION

PATENT NO. : 7,007,318 B1 
DATED : March 7, 2006
INVENTOR(S) : Kevin W. Bork and Timothy E. Perrin It is certified that error appears in the above-identified patent and that said Letters Patent is hereby corrected as shown below:

Column 10,
Line 46, change ":" to -- ; --.

Signed and Sealed this

Thirteenth Day of June, 2006

JON W. DUDAS
*Director of the United States Patent and Trademark Office*